US006953357B2

(12) United States Patent
Fukushima et al.

(10) Patent No.: US 6,953,357 B2
(45) Date of Patent: Oct. 11, 2005

(54) PACKING AND CONNECTOR EQUIPPED WITH THE SAME

(75) Inventors: Hirotaka Fukushima, Shizuoka (JP); Hidehiko Kuboshima, Shizuoka (JP); Chitoshi Nakamura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/822,770

(22) Filed: Apr. 13, 2004

(65) Prior Publication Data

US 2004/0214464 A1 Oct. 28, 2004

(30) Foreign Application Priority Data

Apr. 23, 2003 (JP) ..... 2003-118487

(51) Int. Cl.[7] ..... H01R 13/52
(52) U.S. Cl. ..... 439/271
(58) Field of Search ..... 439/271, 272–275

(56) References Cited

U.S. PATENT DOCUMENTS 2,903,626 A * 9/1959 Nye et al. ..... 174/52.3
2,941,182 A * 6/1960 Heller ..... 439/559
3,701,965 A * 10/1972 DuRocher et al. ..... 439/86
5,879,178 A * 3/1999 Koumatsu et al. ..... 439/271

FOREIGN PATENT DOCUMENTS

JP 2002-151189 5/2002

* cited by examiner

*Primary Examiner*—Renee Luebke
*Assistant Examiner*—James R. Harvey
(74) *Attorney, Agent, or Firm*—Finnegan, Henderson, Farabow, Garrett, & Dunner, L.L.P.

(57) ABSTRACT

A connector 2 includes a connector housing 3, terminal metal fittings and a packing 1. The connector housing 3 which accommodates the terminal metal fittings is coupled with a complementary connector housing. The packing 1 keeps watertight the boundary between the connector housing 3 which is an article and supplementary connector housing 6 which is another article. The packing 1 includes a ring-shaped packing body 13, outer and inner protruding pieces 14 and 15; which protrude from the outer and inner edges of the packing body 13, respectively, holes 16 and securing pieces 17. The thickness of the packing body 13 is larger than the width thereof. Protruding pins 11 of the connector housing 3 are inserted in the holes 16, respectively. The securing pieces 17 are secured in receiving holes of the connector housing 3.

9 Claims, 6 Drawing Sheets

PACKING AND CONNECTOR EQUIPPED WITH THE SAME

BACKGROUND OF THE INVENTION

1. Field of the Invention

This invention relates to a packing for keeping watertight the boundary between articles such as connectors employed for connection of electric wires.

2. Description of the Related Art

Various electronic devices are loaded in a motor vehicle. To this end, a wire harness is arranged to supply a signal or power to the electronic devices. The wire harness includes a plurality of electric wires and a connector attached to the electric wires.

The connector includes terminal metal fittings connected to the electric wires and a connector housing for housing the terminal metal fittings. The wire harness supplies the prescribed signal or power to the various electronic devices in such a way that the connector housings are coupled with each other to connect the terminal metal fittings to each other.

The above connector can be provided with a packing 101 to waterproof the boundary between housings 102 and 103 as shown in FIG. 12 (see JP-A-2002-151189). The packing 101 is made of rubber serving as an elastic material and formed in a ring shape.

The one connector housing 102 which is a first article has a concave groove 104 in which the packing 101 is to be accommodated. It is now assumed that the packing 101 is accommodated in the concave groove 104. When the other connector housing 103 is coupled with the one connector housing 102, as shown in FIG. 12B, the one connector housing 102 is compressed by the outer face of the other connector housing 103 so that it is elastically deformed. The packing 101 makes watertight (also referred to "seal" or "waterproof") the boundary between the inner face of the concave groove 104, i.e. the one connector housing 102 and the connector housing 103.

It is expected that the packing 101 surely waterproof the boundary between the articles such as the above connector housings 102 and 103. In order that the boundary between the articles is waterproofed, the packing 101 is compressed by a prescribed distance to be elastically deformed when the boundary between the articles is waterproofed.

On the other hand, the packing 101 employed for waterproofing the boundary between the connector housings has a round shape in section in an initial state where it is not still elastically deformed. When the packing 101 is elastically deformed as a result of having been compressed by a prescribed distance, its width is increased. As a result, the width of the concave groove 104 must be also increased. Thus, the connector housing 102 tends to be larger. However, it is of course demanded that the connector is smaller.

It is also demanded that the packing 101 is smaller. It can be therefore proposed that the packing is caused to have a width smaller than a thickness as shown in FIG. 13A. It can also be proposed that the width of the concave groove 104 formed in the one connector housing 102 is reduced so that the packing 101 has the elastic deformation enough to waterproof the boundary between the articles, thereby allowing the connector housing 102 to be smaller.

In this case, since the width is smaller than the thickness, when the articles are brought to each other so that the packing 101 is compressed in a direction of thickness, the packing 101 may fall or roll to one side as indicated by two-dot chain line in FIG. 13B. The contact face pressure between the packing 101 and the article cannot be kept so that the packing 101 can not surely waterproof the boundary between the articles.

Thus, a first object of this invention is to provide a smaller packing and surely waterproof the boundary between articles.

A second object of this invention is to provide a connector equipped with a smaller packing and surely waterproof the boundary between a connector housing and a complementary connector housing.

SUMMARY OF THE INVENTION

In order to attain the first object of this invention, there is provided a packing arranged between a first article and a second article for keeping watertight the boundary therebetween, comprising:

a solid-core ring-shaped packing body having a thickness in a first direction in which the first article and the second article face each other larger than a width in a second direction orthogonal to the first direction;

a protruding piece which protrudes from a position where the thickness of the packing is divided into two segments;

a securing portion attached to the protruding piece and secured to the first article.

In this configuration, a securing portion to be secured to the first article is attached to a protruding piece which protrudes from a position where the thickness of the packing is divided into two segments. For this reason, when the packing body is about to fall or roll to one side, an elastic restoring force is produced in the direction of being extended or shrunk between the packing body and the protruding piece. Thus, if the securing portion is secured to the first article, when the packing body is about to fall or roll to one side as a result of having been pushed by the second article, the elastic restoring force acts in a direction opposite to the direction in which the packing is pushed by the second article. This prevents the packing from falling or rolling to one side between the first article and second article, thereby keeping watertight the boundary between the first article and second article.

Further, since the width is smaller than the thickness, the packing itself can be smaller and hence the article can be smaller.

Preferably, the protruding piece is a protruding piece which protrudes inwardly from an inner edge of the solid-core ring-shaped packing. In this configuration, when the packing body is about to fall or roll to one side, the elastic restoring force is produced in the direction of being extended or shrunk between the packing body and the inner protruding piece. Thus, since the securing portion is attached to the first article, when the packing body is about to fall or roll to one side as a result of having been pushed by the second article, the an elastic restoring force is produced in the packing in a direction opposite to the direction in which the packing body is pushed by the second article. This prevents the packing from falling or rolling to one side between the first article and second article, thereby keeping watertight the boundary between the first article and second article.

Preferably, the protruding piece is a protruding piece which protrudes outwardly from an outer edge of the solid-core ring-shaped packing. In this configuration, when the packing body is about to fall or roll to one side, the elastic restoring force is produced in the direction of being extended or shrunk between the packing body and the outer protruding piece. Thus, since the securing portion is secured to the first article, when the packing body is about to fall or roll to one side as a result of having been pushed by the second article, an elastic restoring force is produced in a direction opposite to the direction in which the packing body is pushed by the second article. This prevents the packing from falling or rolling to one side between the first article and second article, thereby keeping watertight the boundary between the first article and second article.

Preferably, the securing portion is a hole which passes through the protruding piece and a protruding pin protruding from the first article is inserted in the hole so that the protruding piece is secured to the first article.

In this configuration, the protruding pin which protrudes from the first article is inserted in the hole which passes through the protruding piece so that the protruding piece can be surely secured to the first article. For this reason, when the packing body is about to fall or roll to one side, the elastic restoring force can be surely produced in a direction of being extended or shrunk between the packing body and the outer protruding piece. This prevents the packing from falling or rolling to one side, between the first article and the second article, thereby keeping watertight the boundary between the first article and the second article.

Preferably, the securing portion is a securing piece which protrudes toward the first article from the protruding piece, and the securing piece is secured in a receiving hole formed in the first article so that the protruding piece is secured to the first article.

In this configuration, the securing piece which protrudes toward the first article from the protruding piece is secured in a receiving hole formed in the first article so that the protruding piece can be secured to the first article. For this reason, when the packing body is about to fall or roll to one side, the elastic restoring force can be surely produced in a direction of being extended or shrunk between the packing body and the outer protruding piece. This prevents the packing from falling or rolling to one side between the first article and the second article, thereby keeping watertight the boundary between the first article and the second article.

Preferably, the packing body includes a first contact portion being opposite to and in contact with the first article and a second contact portion being opposite to and in contact with the second article, the surface of one of the first contact portion and the second contact portion is formed flatly along the surface of one of the first article and the second article, and the other of the first contact portion and the second contact portion is formed to be tapered toward the first article and the second article.

In accordance with this configuration, the one contact portion is elastically deformed along the one surface to-keep watertight the boundary between itself and the one surface. The other contact portion is elastically deformed in a direction of being compressed toward the other surface to keep watertight the boundary between itself and the other surface. Thus, the packing surely keeps watertight the boundary between the first article and the second article.

In order to attain the second object of this invention, there is provided a connector comprising:

a packing, and a connector housing which serves as a first article, the connector housing being to be coupled with a supplementary connector housing which serves as a second article.

In accordance with this configuration, when the packing body is pushed by the complementary connector housing and about to fall or roll to one side, an elastic restoring force can be surely produced in a direction of being extended or shrunk between the packing body and the protruding piece. Namely, since the securing piece is secured to the connector housing, when the packing is pushed by the complementary connector housing and about to fall or roll to one side, the elastic restoring force is generated in a direction opposite to the direction of being pushed from the complementary connector. This prevents the packing from falling or rolling to one side between the connector housing and the complementary connector housing, thereby surely keeping watertight the boundary between the connector housing and the complementary connector housing.

Further, since the width of the packing body is smaller than the thickness, the packing itself can be smaller and the connector housing can be smaller.

The above and other objects and features of the invention will be more apparent from the following description taken in conjunction with the accompanying drawings.

DESCRIPTION OF THE PREFERRED EMBODIMENTS

Figure 1:
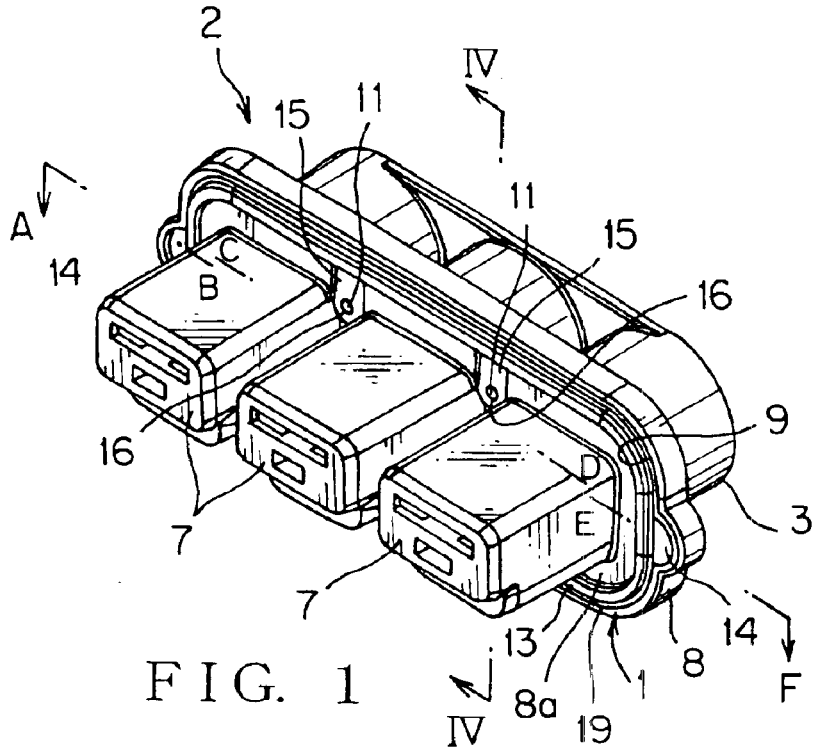
FIG. 1 is a perspective view of a connector equipped with a packing according to an embodiment of this invention.

Now referring to FIGS. 1 to 11, an explanation will be given of an embodiment of this invention. The packing 1 according to an embodiment of this invention shown in FIGS. 1 and 2 constitutes a connector 2. As seen from FIGS. 1 and 2, the connector 2 includes a connector housing 3 which is a first article, a plurality of terminal fittings 4 (FIGS. 3 and 5) and a packing 1.

The connector housing 3 is made of synthetic resin. The connector housing 3 is attached to a case 5*a* of an electronic device such as an inverter loaded in an electric vehicle, a hybrid vehicle, a fuel cell vehicle, etc. The connector 3 is coupled with a complementary connector housing 6 which is a second article.

Figure 3:
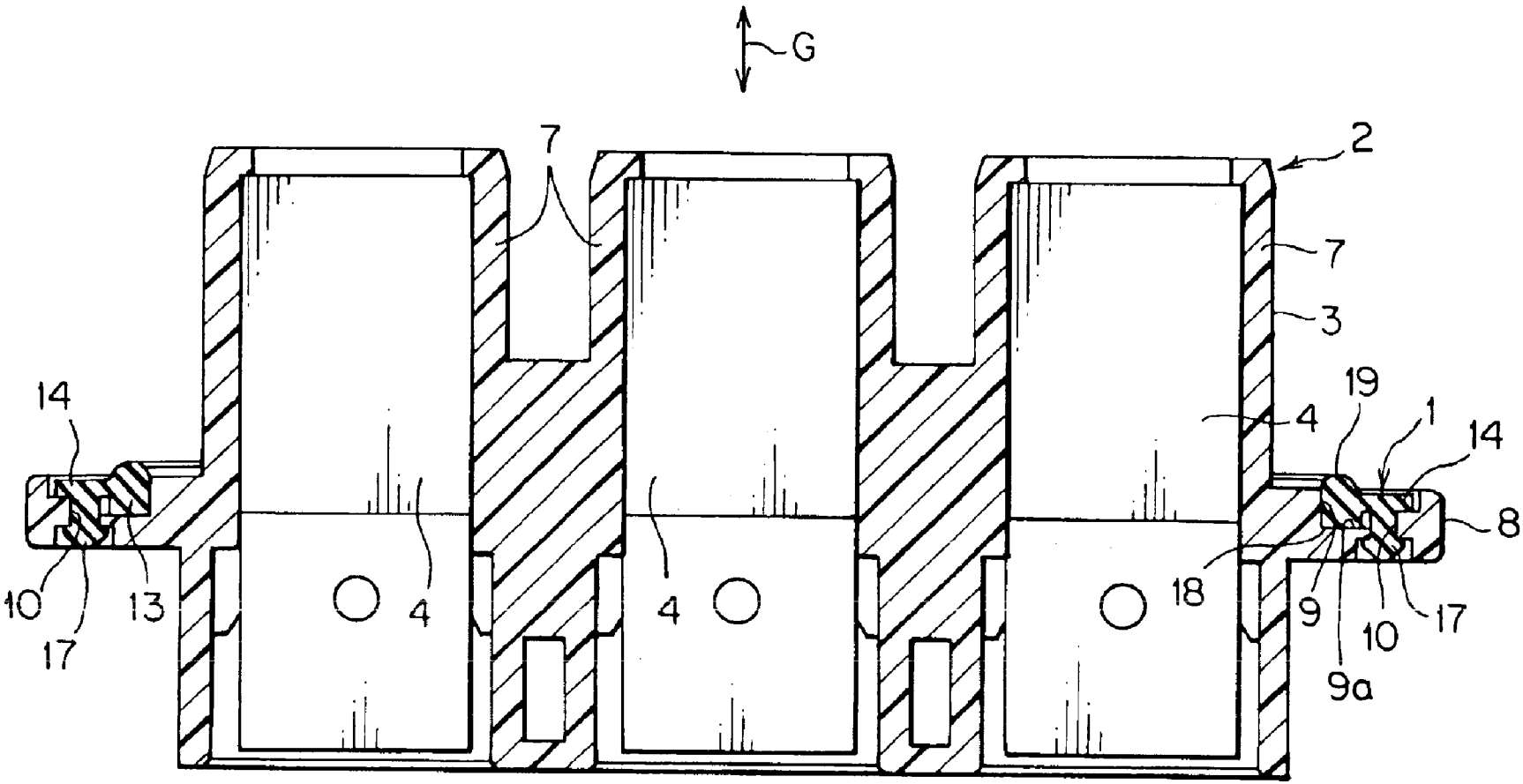
FIG. 3 is a sectional view taken in line A-B-C-D-E-F in FIG. 1.
Figure 4:
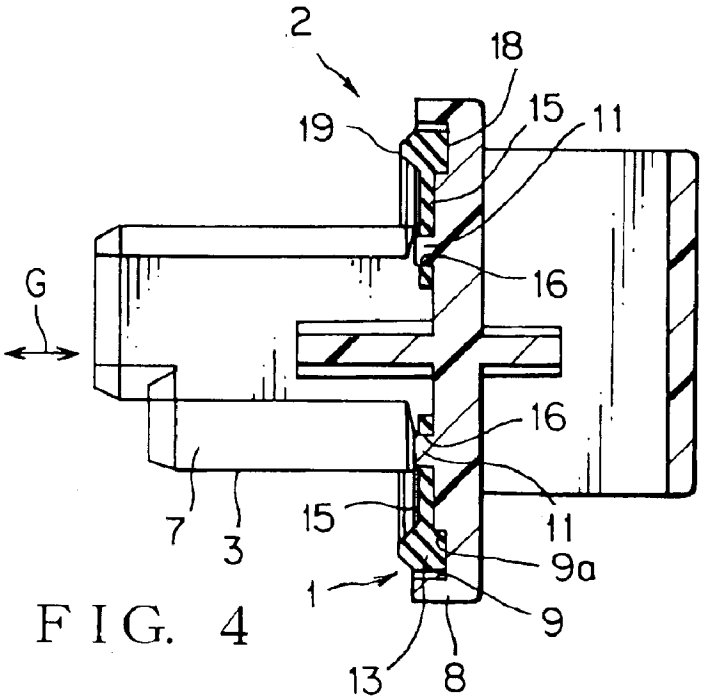
FIG. 4 is a sectional view taken in line VI—VI in FIG. 1.
Figure 5:
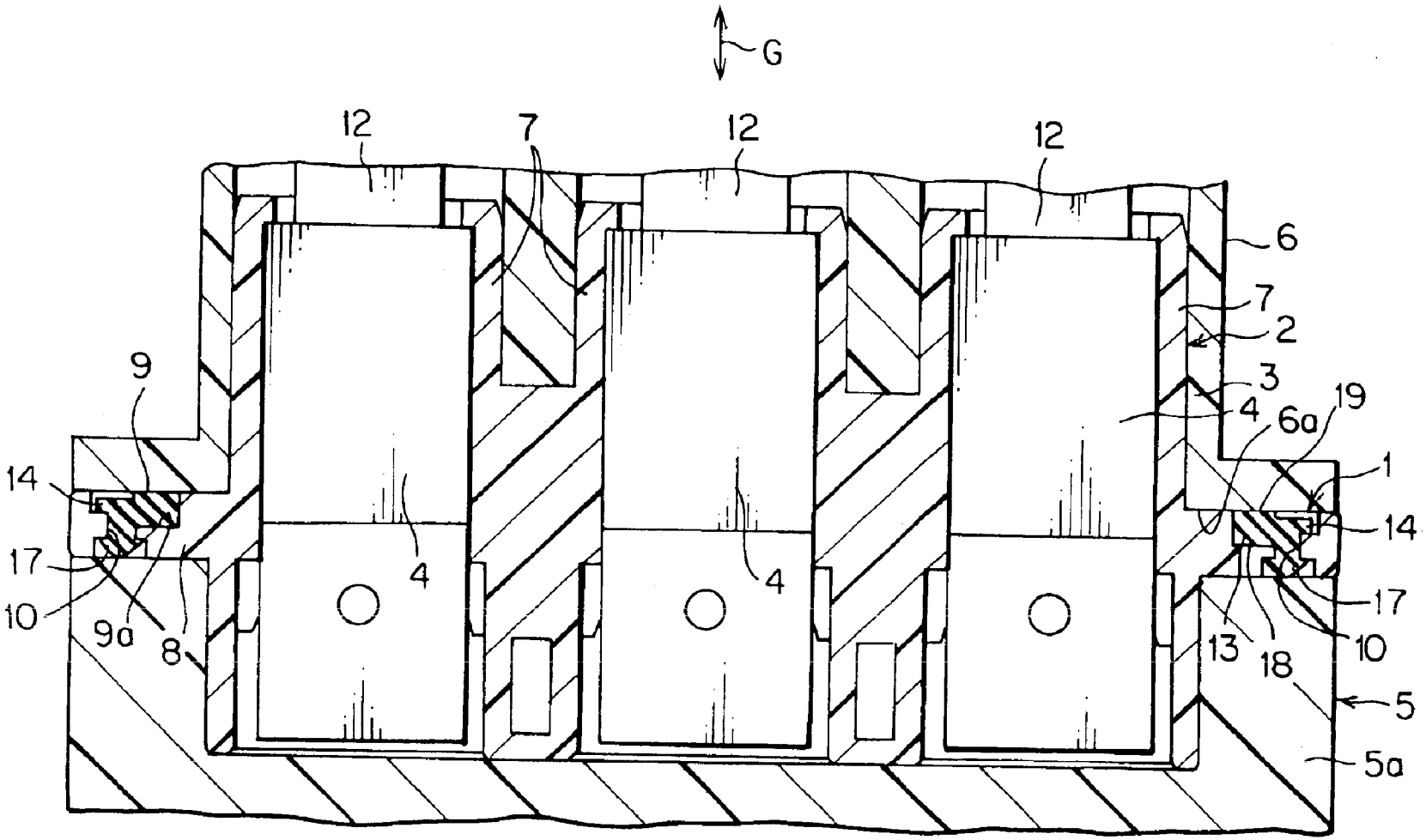
FIG. 5 is a sectional view showing the state where the connector housing of a connector shown in FIG. 3 is coupled with a complementary connector housing.
Figure 8:
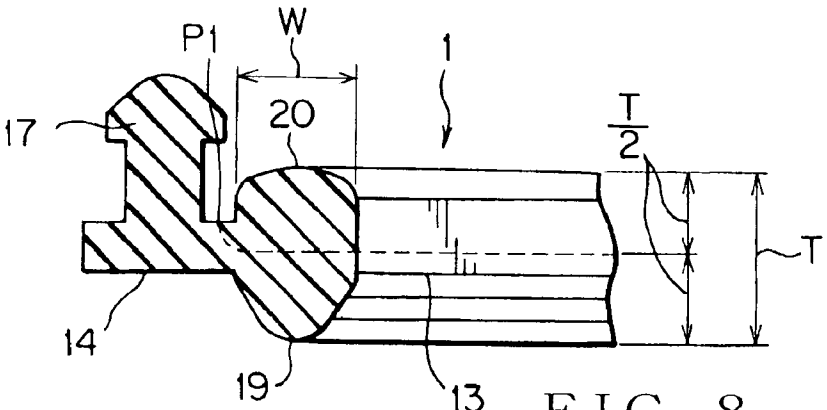
FIG. 8 is an enlarged sectional view of a VIII region in FIG. 6.

The connector housing 3, as shown in FIGS. 1 to 5, includes a plurality of cylinders 7 for accommodating terminal metal fittings 4, respectively and a flange 8 which couples these cylinders with one another and protrudes externally from the outer surface of the cylinders 7. When the connector housing 3 is coupled with the complementary connector housing, the flange 8 overlaps with the outer surface 6*a* of the complementary connector housing 6 (FIG. 5).

Figure 2:
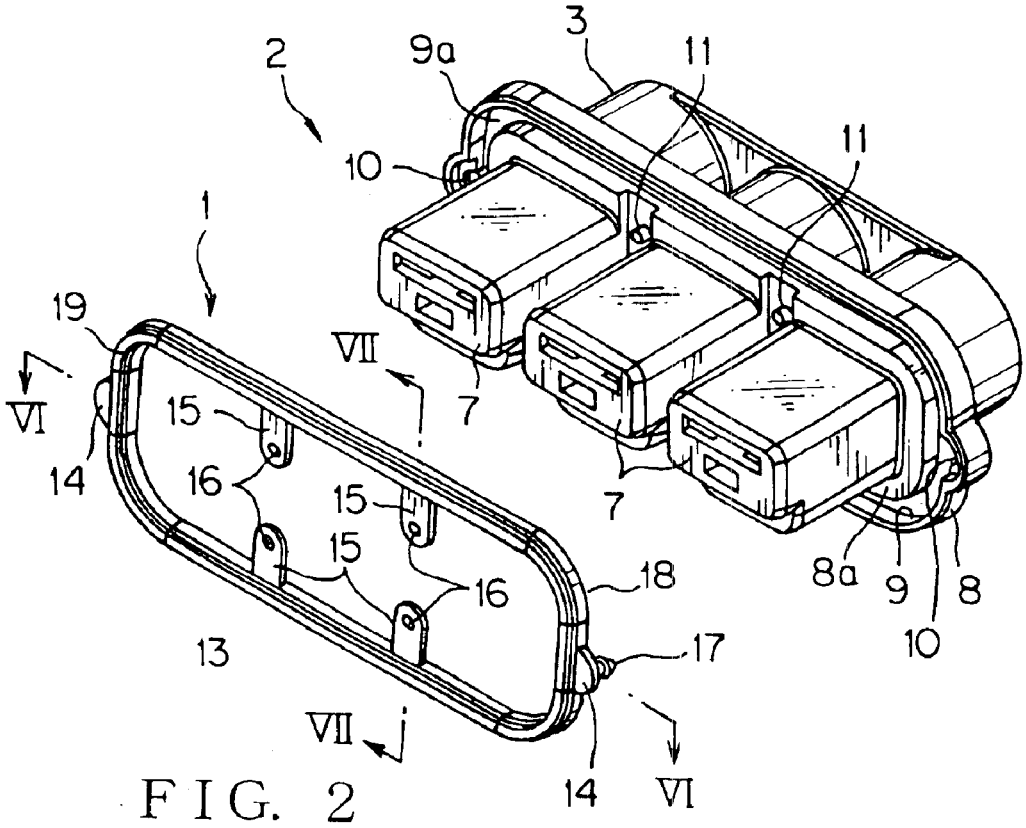
FIG. 2 is an exploded perspective view of the connector shown in FIG. 1.

The flange 8 includes a concave groove 9 (FIGS. 1 and 5), receiving holes 10 and protruding pins 11 (FIGS. 1, 2 and 4). The concave groove 9 is formed in a shape which is concave from the surface 8*a* of the flange 8 opposite to the complementary connector housing 6. The concave groove 9 surrounds the plurality of cylinders 7. The concave groove 9 is formed on the entire periphery of the connector housing 3.

The receiving holes 10 are provided at both edges of the connector housing 3 in the width direction. The receiving holes 10 pass through the flange 8. The receiving holes 10 are formed on the more outer side the cylinders 7 and the connector housing 3 than the concave groove 9.

The protruding pins 11 are provided between the adjacent cylinders 7. The protruding pins 11 protrude toward the complementary connector housing 6 from the surface 8*a* of the flange 8 opposite to the complementary connector housing 6. The protruding pins 11 are formed on the more inner side of the cylinders 7 and the connector housing 3 than the concave groove 9.

The terminal metal fittings 4 are made of conductive metallic plate and accommodated in the cylinders 7 of the connector housing 3, respectively. The terminal metal fittings 4 are electrically connected to bus bars accommodated within the case 5*a* of an electric appliance 5. The terminal metal fittings 4 are connected to the complementary terminal metal fitting 12 accommodated in the complementary connector housing 6 coupled with the connector housing 3, respectively (FIG. 5).

The packing 1 is made of an elastic material which is elastically deformable. As shown in FIG. 2, the packing 1 integrally includes a ring-shaped packing body 13, outer protruding pieces 14, inner protruding pieces 15, holes 16 and securing pieces 17. The holes 16 and securing pieces 17 serve as securing portions.

The packing body 13 is accommodated in the concave groove 9 as shown in FIGS. 1, 3 and 5. In the state where the packing body 13 is accommodated in the concave groove 13, the thickness T (FIGS. 8 and 9) of the packing body 13 in the direction (arrow G in FIG. 3) in which the connector housing 3 and the complementary connector housing 6 are opposite to each other is larger than the width thereof W (FIGS. 8 and 9) in the direction orthogonal to the direction of arrow G.

The thickness T refers to the size of the packing 13 in a direction in which the flange 8 and the complementary connector housing 6 overlap each other in a state where the packing 13 is accommodated in the concave groove 9, i.e. in a direction orthogonal to both the surface 8*a* of the flange 8 and the outer surface 6*a* of the connector housing 6 overlapping the flange 8. The thickness T also refers to the size of the packing 13 in a direction in which the connector housing 3 and complementary connector housing 6 approach each other in a state where the packing 13 is accommodated in the concave groove 9. Further, the thickness T is larger than the depth of the concave groove 9.

The width W refers to the size of the packing 13 in a direction orthogonal to the direction in which the flange 8 and the complementary connector housing 6 overlap each other in a state where the packing 13 is accommodated in the concave groove 9, i.e. in a direction along both the surface 8*a* of the flange 8 and the outer surface 6*a* of the connector housing 6 overlapping the flange 8. The width W also refers to the size of the packing 13 in a direction orthogonal to the direction in which the connector housing 3 and complementary connector housing 6 approach each other in a state where the packing 13 is accommodated in the concave groove 9. Further, the width W designates the size in the radial direction of the packing body 13.

Figure 7:
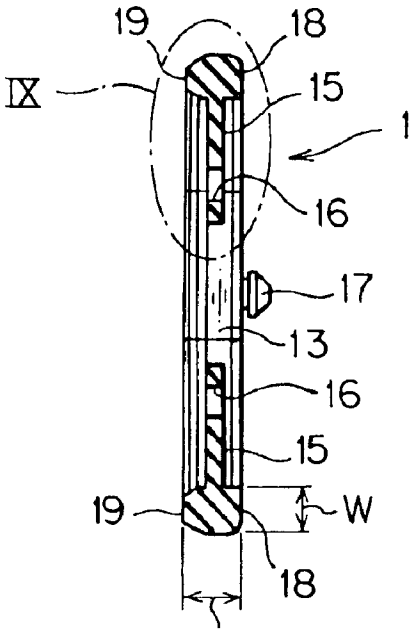
FIG. 7 is a sectional view taken in line VII—VII in FIG. 2.
Figure 6:
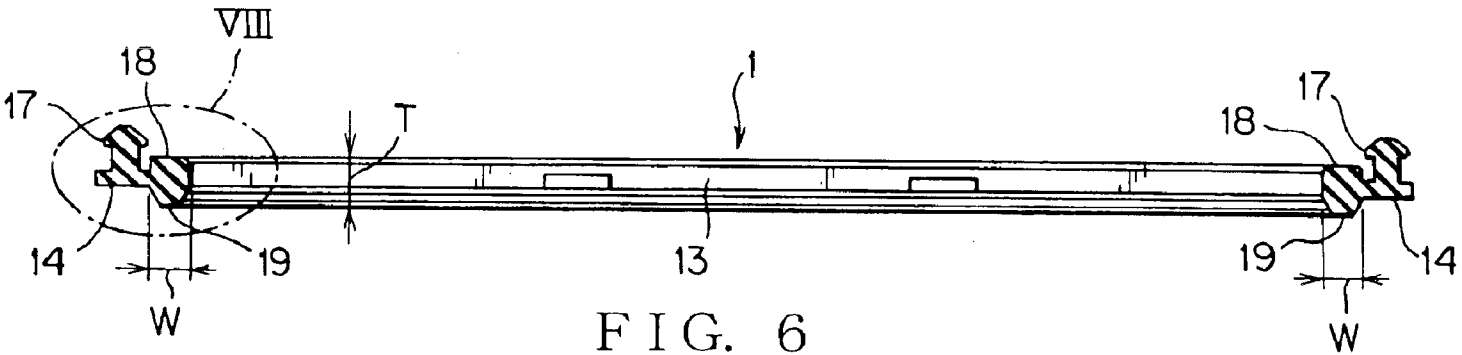
FIG. 6 is a sectional view taken in line VI—VI in FIG. 2.

The packing body 13 in a state where it is accommodated in the concave groove 9, as shown in FIGS. 6 and 7, is provided, over the entire periphery, with a first contact portion 18 in contact with the bottom 9*a* of the concave groove 9 and a second contact portion 19 in contact with the outer surface 6*a* of the complementary connector housing 6 coupled with the connector housing 3. The first contact portion 18 faces the connector housing 3 so as to face the bottom 9*a* of the concave groove 9, and is brought into contact with the connector housing 3 so as to be in contact with the bottom 9*a* of the concave groove 9. The surface of the first contact portion 18 is made substantially flat along the bottom 9*a* of the concave groove 9, i.e. the surface of the connector housing 3.

The second contact portion 19 faces the complementary connector housing 6 so as to face the outer surface 6*a* of the complementary connector 6. The second contact portion 19 is gradually tapered toward the outer surface 6*a* of the complementary connector housing 6, i.e. the complementary connector housing 6.

The packing body 13 is provided between the connector housing 3 and complementary connector housing 6 in such a manner that the first contact portion 18 is in contact with the bottom 9*a* of the concave groove 9 and the second contact portion 19 is elastically deformed when compressed by the outer surface 6*a*. Thus, the packing 1 keeps watertight the boundary between the bottom 9*a* of the concave groove 9, i.e. connector housing 3 and the outer surface 6*a*, i.e. connector housing 6.

The outer protruding pieces 14, as shown in FIGS. 1, 2, 3 and 6, are provided at both outer edges in the width direction of the packing body 13. The outer protruding pieces 14 each protrudes outwardly of the packing body 13 from the outer edge of the packing body 13. The outer protruding pieces 14 protrude from the position P1 at a midpoint along the thickness T of the packing body 13.

The outer protruding piece 14, when the packing body 13 is accommodated in the concave groove 9, overlaps the receiving hole 10. The same number of outer protruding pieces 14 as the receiving holes 10 are provided.

The inner protruding pieces 15, as shown in FIGS. 1, 2, 4 and 7, protrude inwardly of the packing body 13 from the inner edge of the packing body 13. The inner protruding piece 15 protrudes from the position P2 at a midpoint along the thickness T of the packing body 13.

The inner protruding piece 15, when the packing body 13 is accommodated in the concave groove 9, overlaps the protruding pin 11. The same number of inner protruding pieces 15 as the protruding pins 11 are provided.

Holes 16, as shown in FIGS. 1, 2, 4, 7 and 9, are provided in the inner protruding pieces 15, respectively. The hole 16 passes through the inner protruding piece 15. Protruding pins 11, which protrude from the flange 8 of the connector housing 3, are inserted in the holes 16, respectively. Thus, the packing body 13, i.e. packing 1 is fixed in the concave groove 9, i.e. fixed to the connector housing 3.

Securing pieces 17, as shown in FIGS. 2, 3, 5, 6 and 8, are provided for the outer protruding pieces 14, respectively.

The securing piece 17 protrudes toward the connector housing 3 from the outer protruding piece 14. The securing piece 17 is pressed into the receiving hole 10 so it is secured to the receiving hole 10. The securing piece 17 is secured to the receiving hole 10 so that the packing body 13, i.e. packing 1 is fixed in the concave groove 9, i.e. to the connector housing 3.

Figure 10:
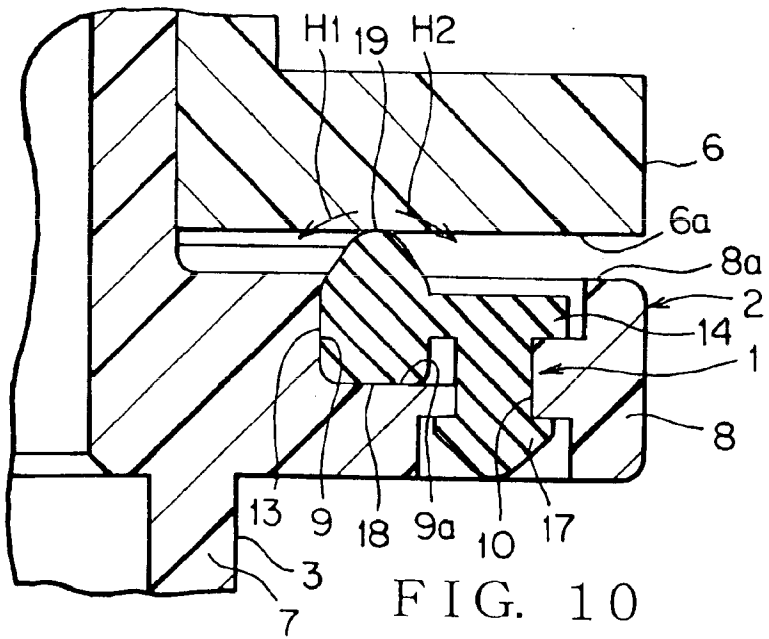
FIG. 10 is an enlarged sectional view of the main part on the way of coupling the connector housing of the connector shown in FIG. 3 with a complementary connector housing.
Figure 9:
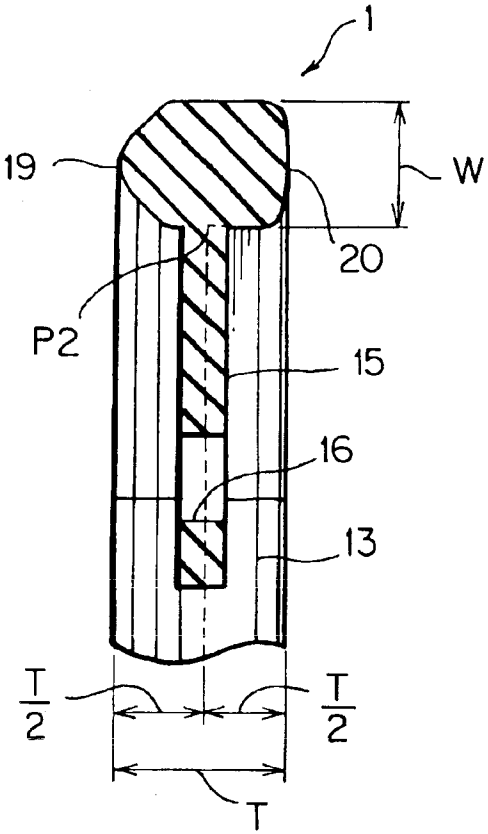
FIG. 9 is an enlarged sectional view of a IX region in FIG. 7.
Figure 11:
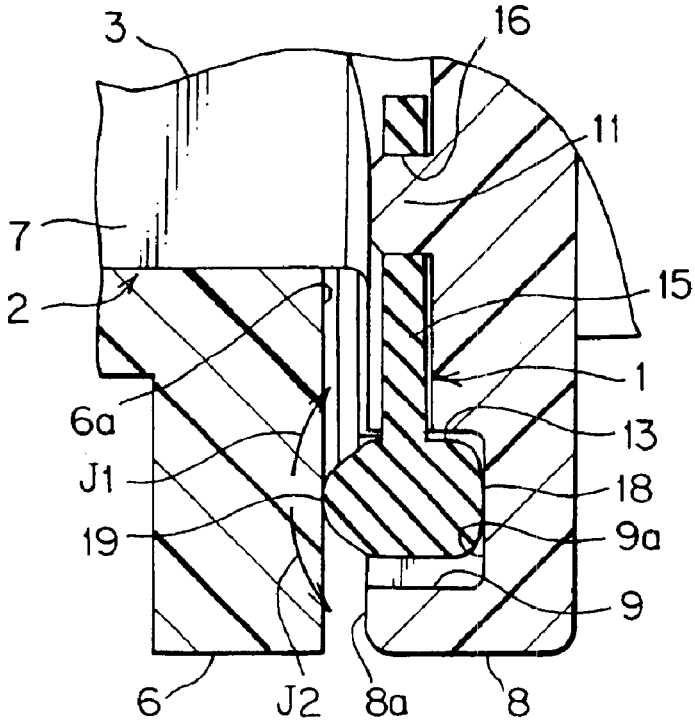
FIG. 11 is an enlarged sectional view of the main part on the way of coupling the connector housing of the connector shown in FIG. 4 with a complementary connector housing.
Figure 12A:
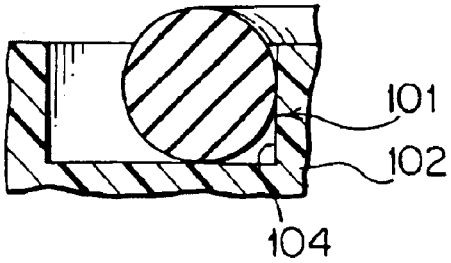
PRIOR ART FIG. 12A
FIG. 12A is a sectional view of a conventional packing employed for waterproof the boundary between connector housings of a connector.
Figure 13A:
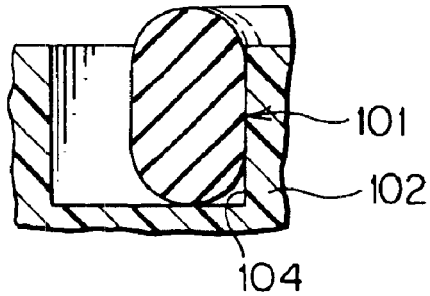
PRIOR ART FIG. 13A
FIG. 13A is a sectional view of another conventional packing employed for waterproof the boundary between connector housings of a connector.
Figure 12B:
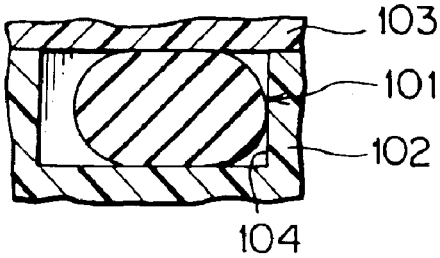
PRIOR ART FIG. 12B
FIG. 12B is a view showing the state where the packing shown in FIG. 12A waterproofs the boundary between the connector housings.
Figure 13B:
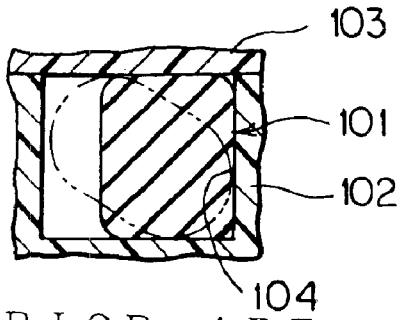
PRIOR ART FIG. 13B
FIG. 13B is a view showing the state where the packing shown in FIG. 13A waterproofs the boundary between the connector housings.

The connector housing 3 equipped with the packing 1, i.e. connector 2 is coupled with the complementary connector housing 6. Then, as shown in FIGS. 10 and 11, the outer surface 6*a* of the complementary connector housing 6 is brought into contact with the second portion 19 of the packing 1. This causes the connector housing 3 and the complementary connector housing 6 to approach each other against the elastic restoring force of the packing body 13, i.e. packing 1.

Thus, for example, the second contact portion 19 is about be bent along arrow H1 in FIG. 10 and arrow J1 in FIG. 11 by the complementary connector housing 6. Namely, the second contact portion 19 is about to fall or roll in the direction of arrows H1 and J1 in FIGS. 10 and 11 around the first contact portion 18.

Then, the securing pieces 17 are secured in the receiving holes 10, respectively and the protruding pins 11 are inserted in the holes 16, respectively so that the outer and inner protruding pieces 14 and 15 are fixed to the connector housing 3. Thus, the elastic restoring force is produced in the packing 1 along arrows H2 and J2 in FIGS. 10 and 11, opposite to the arrows H1 and J1. The packing body 13 is prevented from falling or rolling along the arrows H1 and J1 around the first contact portion 18.

Thus, the connector housing 3 and the complementary connector housing 6 are coupled with each other. The first contact portion 18 is brought into contact with the bottom 9*a* of the concave groove 9, whereas the second contact portion is elastically deformed in a direction of being compressed so that the packing 1 keeps watertight the boundary between the flange 8 of the connector housing 3 and the complementary connector housing 6.

The second contact portion 19 may be about to be bent along arrow H2 in FIG. 10 and J2 in FIG. 11 by the complementary connector housing 6. Namely, the second contact portion 19 may be about to fall or roll along arrows H2 and J2 around the first contact portion 18.

Meanwhile, the securing pieces 17 have been secured in the receiving holes 10, respectively, and the protruding pins 11 have been inserted in the holes 10, respectively so that the outer and inner protruding pieces 14 and 15 are fixed to the connector housing 3. For this reason, the elastic restoring force is produced in the packing 1 along arrows H1 and J1 opposite to arrows H2 and J2. Thus, the packing body 13 is prevented from falling or rolling along arrows H2 and J2 around the first contact portion 18.

In this way, the outer protruding pieces 14 and 15 serve as propping bars or pulling bars so that packing 1 can prevent the packing body 13 from falling or rolling around the first contact portion 18.

In accordance with this embodiment, the protruding pieces 14 and 15 which protrude from positions P1 and P2, respectively, at midpoint along the thickness T of the packing body 13 are provided with securing pieces 17 and holes 16, respectively, which serve as securing portions to be secured to the connector housing 3. The securing pieces 17 and holes 16 are secured to the connector housing 3 so that when the packing body 13 is about to fall or roll to one side, an elastic restoring force is produced in the direction of being extended or shrunk between the packing body 13 and the protruding pieces 14 and 15 along arrows H1, H2 and J1, J2.

Thus, since the securing pieces 17 and holes 16 which serve as the securing portions are secured to the connector housing 3, when the packing 1 is pushed by the complementary connector housing 6 so as to fall or roll to one side, the elastic restoring force is produced in the packing 1 in the direction opposite to the direction of being pushed by the complementary connector housing. This prevents the packing body 13 from falling or rolling to one side between the connector housing 3 and the complementary connector housing. Thus, the packing 1 surely keeps watertight the boundary between the connector housing 3 and the supplementary connector housing 6.

Since the width W of the packing body 13 is smaller than the thickness T thereof, the packing 1 itself can be smaller and the width of the concave groove 9 can be decreased. Thus, the connector housing 3 can be also smaller.

The packing 1 includes inner protruding pieces 15 which protrude from the inner edge of the packing body 13. The protruding pins 11 which protrude from the connector housing 3 are inserted in the holes 16 which penetrate through the inner protruding pieces 15, respectively. The holes 16, therefore, permit the inner protruding pieces 15 and the connector housing 3 to be surely fixed to each other.

The packing 1 also includes the outer protruding pieces 14 which protrude from the outer edge of the packing body 13. The securing pieces 17 which protrude from the outer protruding pieces 14 toward the connector housing 3 are secured in the receiving holes 10 formed in the connector housing 3. Thus, the securing pieces 17, therefore, permit the outer protruding pieces 14 and the connector housing 3 to be surely fixed to each other.

Thus, since the securing pieces 17 and holes 16 which serve as the securing portions are secured to the connector housing 3, when the packing 1 is about to fall or roll to one side, an elastic restoring force is produced in the direction of being extended or shrunk between the packing body 13 and the protroding pieces 14 and 15 along arrows H1, H2 and J1, J2. This prevents the packing body 13 from falling or rolling to one side between the connector housing 3 and the supplementary connector housing 6. Thus, the packing 1 surely keeps watertight the boundary between the connector housing 3 and the supplementary connector housing 6.

The first contact portion 18 is formed along the bottom 9*a* of the concave groove 9 of the connector housing 3. The second contact portion 19 is formed to be tapered toward the outer surface 6*a* of the supplementary connector housing 6. The packing 1 will be elastically deformed in a direction in which the first contact portion 18 extends along the bottom 9*a* of the concave groove 9 of the connector housing 3 and the second contact portion 19 is compressed toward the outer surface 6*a* of the supplementary connector housing 6.

Thus, the first contact portion 18 surely keeps watertight the boundary between itself and the bottom 9*a* of the concave groove 9 of the connector housing 3. The second contact portion 19 surely keeps watertight the boundary between itself and the outer surface 6*a* of the complementary connector housing 6. Accordingly, the packing 1 keeps watertight the boundary between the connector housing 3 and the complementary connector housing 6.

In accordance with this invention, the packing 1 includes the outer protruding pieces 14 and the inner protruding pieces 15. However, the packing 1 according to this invention may include at least one of the outer protruding pieces 14 and the inner protruding pieces 15.

In accordance with this invention, the outer protruding piece 14 is equipped with the securing piece 17 whereas the inner protruding piece 15 is equipped with the hole 16. However, in the packing 1 according to this invention, the outer protruding piece 14 may be equipped with the hole 16 whereas the inner protruding piece 5 maybe equipped with the securing piece 17.

In the embodiment described above, the first contact portion 18 is formed to be flat along the bottom 9*a* of the concave groove 9 of the connector housing 3, and the second contact portion 19 is formed to be tapered toward the outer surface 6*a* of the supplementary connector housing 6. In this invention, the first contact portion 18 in contact with the bottom 9*a* of the concave groove 9 may be formed to be tapered toward the bottom 9*a* of the concave groove 9, i.e. connector housing 3, and the second contact portion 19 in contact with the outer surface of the supplementary connector housing 6 may be formed to be flat along the outer surface 6*a* of the supplementary connector housing 6.

In the embodiment described above, the packing 1 is arranged between the connector housings 3 and 6 to keep watertight the boundary therebetween. However, the packing 1 according to this invention may be arranged between the various articles other than the connector housings to keep watertight the boundary therebetween.

What is claimed is:

1. A packing arranged between a first article and a second article for keeping watertight the boundary therebetween, comprising:

a solid-core ring-shaped packing body having a thickness in a first direction in which the first article and the second article face each other larger than a width in a second direction orthogonal to the first direction;

a first protruding piece which protrudes outwardly from an outer edge of said solid-core ring-shaped packing body at a midpoint along the thickness of the packing body a securing portion attached to said first protruding piece and secured to said first article, a second protruding piece which protrudes inwardly from an inner edge of said solid-core ring-shaped packing body;

wherein the securing portion extends from the first protruding piece so that the first portruding piece provides a restoring force preventing said packing body from falling or rolling to one side when the first and second articles are mated.

2. A packing according to claim 1 further comprising a hole which passes through the second protruding piece and a protruding pin protruding from said first article is inserted in the hole so that the second protruding piece is secured to the first article.

3. A packing according to claim 1, wherein said securing portion is a securing piece which protrudes toward the first article from said first protruding piece, and the securing piece is secured in a receiving hole formed in the first article so that said first protruding piece is secured to said first article.

4. A packing according to claim 1, wherein said packing body includes a first contact portion being opposite to and in contact with said first article and a second contact portion being opposite to and in contact with said second article, one of said first contact portion and said second contact portion is formed flatly along a complimentary surface of one of said first article and said second article, and the other of said first contact portion and said second contact portion is formed to be tapered toward the other of said first article and said second article.

5. A connector comprising:

a packing according to claim 1, and a connector housing which serves as a first article, said connector housing being coupled with a supplementary connector housing which serves as a second article.

6. A packing extending between a first article and a second article for maintaining a substantially watertight boundary therebetween, comprising:

a solid-core ring-shaped packing body having a thickness that extends in the direction of mating of the first article and the second article;

a first protruding piece that protrudes outwardly from an outer edge of the packing body at a midpoint along the thickness of the packing body;

a second protruding piece that protrudes inwardly from an inner edge of the packing body;

a securing portion secured to the first article and extending from the first protruding piece so that the first protruding piece provides a restoring force preventing the packing body from falling or rolling to one side when the first and second articles are mated.

7. A packing according to claim 6, further comprising a second securing portion including a hole that passes through the second protruding piece, wherein a protruding pin protrudes from the first article through the hole so that the protruding piece is secured to the first article.

8. A packing according to claim 6, wherein the securing portion is a securing piece that protrudes from the first protruding piece and is adapted to extend through a receiving hole formed in the first article so that the first protruding piece is secured to the first article.

9. A packing extending between a first article and a second article for maintaining a substantially watertight boundary therebetween, the packing including a ring-shaped packing body having a thickness that extends in the direction of mating of the first article and the second article, the packing body comprising:

a first protruding piece that protrudes outwardly from an outer edge of the packing body at a midpoint along the thickness of the packing body;

a securing portion extending from the first protruding piece and secured to the first article;

a second protruding piece which protrudes inwardly from an inner edge of said packing body;

a first contact portion that is opposite to and in contact with the first article; and a second contact portion that is opposite to and in contact with the second article, wherein one of the first contact portion and the second contact portion extends flatly along a complimentary surface of one of the first article and the second article, and wherein the other of the first contact portion and the second contact portion is formed to be tapered toward the other of the first article and the second article.

* * * * *